US010562738B2

(12) United States Patent
Sonnenmoser et al.

(10) Patent No.: US 10,562,738 B2
(45) Date of Patent: Feb. 18, 2020

(54) ELEVATOR SYSTEM COMPRISING WITH A SAFETY MONITORING SYSTEM WITH A MASTER-SLAVE HIERARCHY

(71) Applicant: Inventio AG, Hergiswil (CH)

(72) Inventors: Astrid Sonnenmoser, Hochdorf (CH); David Michel, Thalwil (CH); Reto Tschuppert, Lucerne (CH)

(73) Assignee: INVENTIO AG, Hergiswil NW (CH)

( * ) Notice: Subject to any disclaimer, the term of this patent is extended or adjusted under 35 U.S.C. 154(b) by 372 days.

(21) Appl. No.: 15/533,734

(22) PCT Filed: Dec. 7, 2015

(86) PCT No.: PCT/EP2015/078771
§ 371 (c)(1),
(2) Date: Jun. 7, 2017

(87) PCT Pub. No.: WO2016/091779
PCT Pub. Date: Jun. 16, 2016

(65) Prior Publication Data

US 2017/0334678 A1 Nov. 23, 2017

(30) Foreign Application Priority Data

Dec. 10, 2014 (EP) ..... 14197111

(51) Int. Cl.
*B66B 5/00* (2006.01)
*B66B 1/00* (2006.01)
(Continued)

(52) U.S. Cl.
CPC ..... *B66B 5/0031* (2013.01); *B66B 1/3438* (2013.01); *B66B 1/3446* (2013.01); *B66B 9/00* (2013.01)

(58) Field of Classification Search
CPC ... B66B 5/0031; B66B 5/0006; B66B 5/0025; B66B 5/0037
See application file for complete search history.

(56) References Cited

U.S. PATENT DOCUMENTS

2009/0050417 A1* 2/2009 de Groot ..... B66B 1/2458 187/387
2009/0277724 A1* 11/2009 Thumm ..... B66B 1/34 187/393

(Continued)

FOREIGN PATENT DOCUMENTS

CN 201077702 Y 6/2008
EP 2022742 A1 2/2009

*Primary Examiner* — Marlon T Fletcher
(74) *Attorney, Agent, or Firm* — William J. Clemens; Shumaker, Loop & Kendrick, LLP

(57) ABSTRACT

An elevator system has a drive, a car, a plurality of safety function components for providing safety functions at various positions, and a safety monitoring system with a plurality of safety monitoring units for monitoring all of the safety function components. The monitoring units have an input interface for reading in data or signals and an output interface for outputting control signals to an assigned member of the safety function components, at least some of the monitoring units being connected via data exchange channels. The monitoring units are organized in a master-slave hierarchy, with one unit designed as a master unit, and at least one other unit designed as a slave unit. The decentralized and distributed monitoring units, each having data processing capability, and the master-slave organization result in the elevator system exhibiting a high security level with low cabling complexity and cost expenditure, in particular for high rise elevators.

14 Claims, 1 Drawing Sheet

(51) Int. Cl.
*B66B 1/34* (2006.01)
*B66B 9/00* (2006.01)

(56) References Cited

U.S. PATENT DOCUMENTS

2010/0051391 A1* 3/2010 Jahkonen ..... B66B 5/0018
187/393
2011/0259674 A1* 10/2011 Silberhorn ..... B66B 5/0031
187/247
2011/0302466 A1 12/2011 Ikawa et al.
2013/0118836 A1* 5/2013 Rossignol ..... B66B 1/28
187/247
2013/0192932 A1* 8/2013 Parillo ..... B66B 5/0018
187/289
2015/0166305 A1* 6/2015 Kalliomaki ..... B66B 7/064
187/254
2015/0336768 A1* 11/2015 Otsuka ..... B66B 1/3492
187/394
2018/0022574 A1* 1/2018 Pasini ..... B66B 11/0407
187/247

* cited by examiner

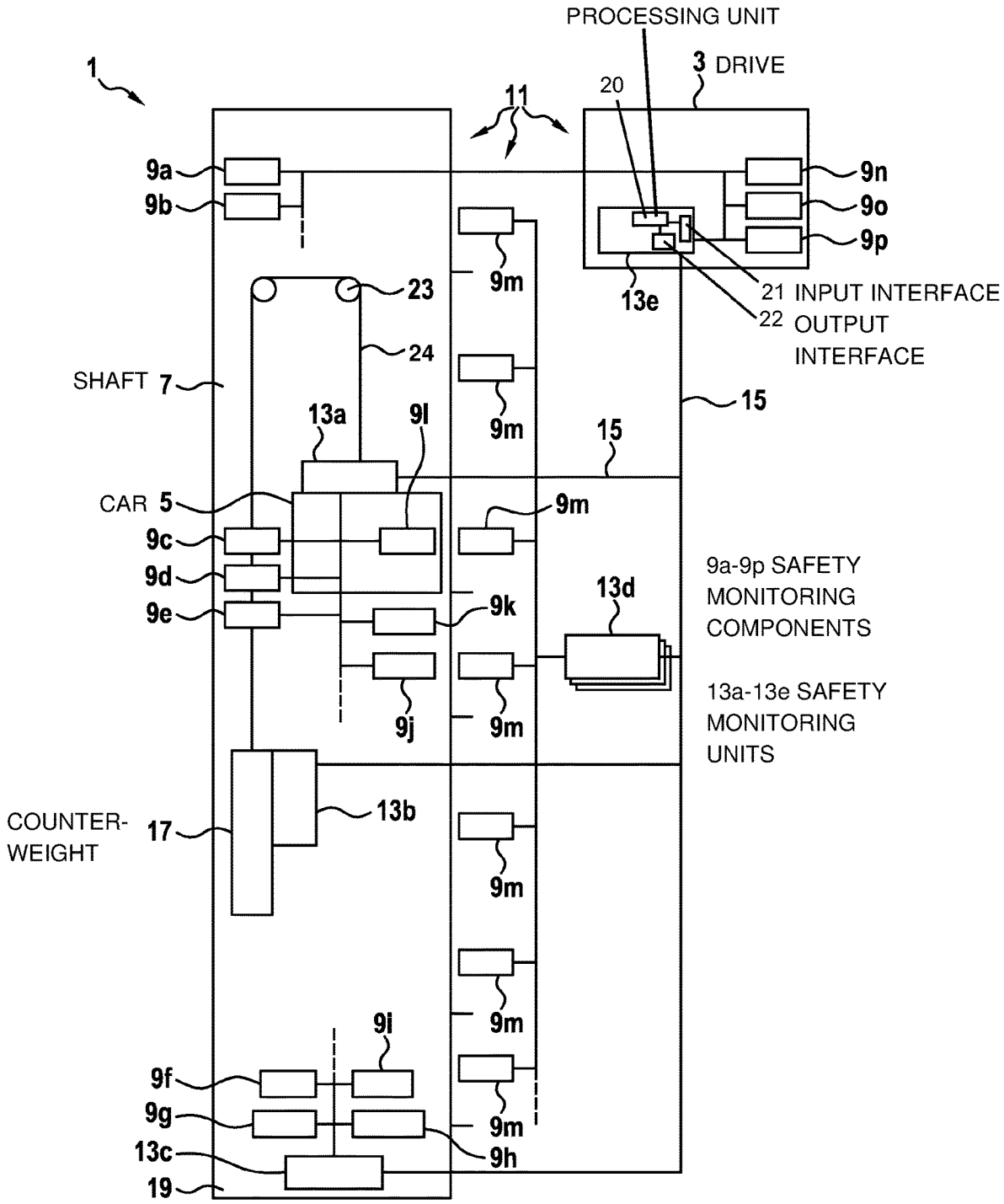
PROCESSING UNIT
3 DRIVE
20
1
11
9a
9b
9n
9o
9p
9m
23
13e
21 INPUT INTERFACE
22 OUTPUT INTERFACE
24
SHAFT 7
15
13a
9l
15
CAR 5
9m
9c
9d
9e
9k
13d
9a-9p SAFETY MONITORING COMPONENTS
9j
9m
13a-13e SAFETY MONITORING UNITS
COUNTER-WEIGHT 17
13b
9m
9m
9i
9f
9g
9m
13c
9h
19

ELEVATOR SYSTEM COMPRISING WITH A SAFETY MONITORING SYSTEM WITH A MASTER-SLAVE HIERARCHY

FIELD

The present invention concerns an elevator system, in particular an elevator system with a safety monitoring system.

BACKGROUND

In general terms elevator systems serve the purpose of transporting persons or items in the vertical direction. In order thereby to avoid hazards to the persons or items, safety monitoring systems are regularly deployed. These monitor the current operating conditions of the elevator system, for example with the aid of detecting safety function components, i.e. for example by means of data or signals from sensors or from control devices. For example, a speed of an elevator car, or a state of closure of doors of the elevator system, is monitored. In the event of a critical operating condition the safety monitoring system activates suitable activatable safety function components, such as, for example, a braking device or a capturing device for purposes of braking, that is to say stopping, the elevator car. Here the most stringent requirements are placed on the safety monitoring systems with regard to their reliability and security.

Conventional safety monitoring systems often employ a central safety monitoring unit, which is connected to a multiplicity of detecting safety function components, or activatable safety function components, which have been arranged at various positions within the elevator system. By way of example, a detecting safety function component can be understood to mean, for example, a sensor or an output interface of a control device, which can determine and output signals or data that provide information on a current operating condition within the elevator system. An activatable safety function component can be understood to be, for example, an actuator, a motor, or similar, which can actively influence a current operating condition within the elevator system. Here signals or data, e.g. from sensors, will have been transmitted in each case to the central safety monitoring unit and processed there. If it has been recognized on the basis of processed results that, for example, a safety critical operating condition prevails in the elevator system, the central safety monitoring unit will have appropriately controlled one or a plurality of the activatable safety function components in order to ensure the safety of the elevator system and in particular of the persons being transported. For example, a braking or capturing device will have been activated when an excessive speed of the elevator car has been detected. Signals or data generated by sensors will have been transmitted unprocessed to the central safety monitoring unit, processed exclusively there, and then, based on the processed results, control signals will have been generated, which will have been sent to the activatable safety function components, in order to activate the latter in a suitable manner.

However, such a centrally monitored and controlled system regularly requires highly complex wiring. In addition, significant signal propagation times can occur between the locally provided detecting and activatable safety function components and the centrally provided safety monitoring unit, whereby the reaction times required by the safety monitoring system in order to react adequately to a critical situation that has occurred can be considerably lengthened.

In addition, transmission of signals and data, for example from a multiplicity of distributed sensors to a single central safety monitoring unit and central data processing taking place there, can lead to significant processing times and thus can lengthen the reaction times further.

EP 2 022 742 A1 therefore proposes an elevator system with a decentralized control system. The decentralized control system has a plurality of evaluation units, wherein signals can be transmitted via bus connections between the evaluation units. Compared with centralized systems, this can reduce the wiring complexity and can shorten reaction times.

US 2011302466 A1 describes an elevator system with a safety monitoring system for purposes of monitoring safety function components. The safety monitoring system has a master unit and many slave units. The slave units are each assigned sensors and switches and receive signals, which they transmit to the master unit in a particularly well secured method. The master unit processes these data and activates, as appropriate, suitable safety function components, for example for stopping the elevator car.

SUMMARY

Amongst other items, there may be a need for a further improved elevator system with an optimized, and at least partially decentralized, safety monitoring system.

In accordance with one aspect of the invention, an elevator system is proposed, which has a drive, a car, a plurality of safety function components for purposes of providing safety functions at various positions within the elevator system, and a safety monitoring system for purposes of monitoring all the safety function components. The safety monitoring system has a plurality of safety monitoring units. The car is operatively connected with the drive and by means of the drive can be driven along a path of travel. The elevator system is characterized in that at least some, preferably each, of the safety monitoring units, has an input interface for purposes of reading in data or signals. At least some of the safety monitoring units of the safety monitoring system are thereby connected with one another via data exchange channels. Here the safety monitoring units of the safety monitoring system are organized in the form of a master-slave hierarchy, wherein one of the safety monitoring units is designed as a master unit and at least one of the safety monitoring units is designed as a slave unit. In accordance with the invention, at least one slave unit has a data processing unit for purposes of processing the data or signals into control signals, together with an output interface for purposes of outputting the control signals to at least one safety function component assigned to the respective safety monitoring unit.

Ideas related to forms of embodiment of the present invention can be considered, inter alia, to be based on the thoughts and insights described below, without, however, limiting the invention in any way.

In summary, it has been recognized that a safety monitoring system of an elevator system can be designed particularly securely and efficiently if a plurality of safety monitoring units are arranged in a decentralized manner, of which at least some can not only forward signals, which are, for example, provided by sensors or other control devices, to a central unit, but are able to process these signals themselves, and as a consequence can control safety function components. These decentralized safety monitoring units are thus able to read in local data, for example from sensors or control devices, to process the same, and then to control related safety function components. However, in order to enable communication between the individual decentralized safety monitoring units, these are connected with one another via data exchange channels, via which data or signals can be transmitted. The safety monitoring units can thus communicate with one another. In this manner, a plurality of safety monitoring units can be combined to form a total safety monitoring system, with the aid of which an entire elevator system can be monitored.

In this context, it has been found to be particularly advantageous to organize the plurality of safety monitoring units in the form of a master-slave hierarchy. Here one of the safety monitoring units is designed as a master unit, while at least one other safety monitoring unit is designed as a slave unit. In such a master-slave hierarchy, the master unit is superordinate to the slave unit or units, i.e. it has, for example, priority rights with regard to the requirement, transmission and/or further processing of signals and data, and also with regard to the control of safety function components.

The master unit can, for example, cause a slave unit to assume a specific operating mode, in which the slave unit only transmits signals or data from its assigned sensors or devices to the master unit. The master unit can process these signals and then instruct the slave unit to control the associated safety function components in a manner determined by the master unit. Alternatively, the master unit can authorize the slave unit to process such signals or data itself, and based on the processed results to control the safety function components independently.

It is also possible for a slave unit to have only one input interface, and just to forward signals or data from its assigned sensors or devices to the master unit or to other slave units. Such slave units can be designed more simply and thus more cost-effectively.

In accordance with one form of embodiment of the invention, all slave units can have a data processing unit for purposes of processing the data or signals into control signals, together with an output interface for purposes of outputting the control signals to at least one safety function component assigned to the respective safety monitoring unit. By this means a maximum flexibility in the interaction between the safety monitoring units can be achieved.

In other words, in accordance with one form of embodiment of the invention, at least one slave unit can be configured to read in, via the input interface, data or signals indicating a safety condition within the elevator system and to process them by means of the data processing unit, and independently to control the assigned safety function component based on processed results. At least this one slave unit is therefore able to process independently, for example, signals or data delivered by sensors, and to actuate independently a safety function component. The slave unit can thus execute a proportion of the safety monitoring necessary in the elevator system actively and independently. Here the slave unit can be connected with its assigned detecting and/or activatable safety function components, and can preferably be arranged in local proximity to these. As a result of this local proximity, times for transmission of data and signals can be kept short. In particular, data can be processed in a decentralized manner locally in the slave unit and need not be transmitted over long distances to a centrally arranged data processing device.

The same slave unit, in another operating mode in accordance with one form of embodiment of the invention, can be designed to read in, via the input interface, data or signals indicating a safety condition within the elevator system and to transmit them to the master unit via the data exchange channel. The master unit can then be configured to process the transmitted data or signals by means of its data processing unit and to transmit the processed results to the slave unit via the data exchange channel. Finally, the slave unit can be configured to control an assigned safety function component based on the transmitted processed results. In this case, the slave unit operates in a passive manner and only passes signals or data from sensors or other devices to the master unit, and forwards control commands from the master unit onto its assigned safety function components. However, the actual data processing does not take place in the slave unit, which is passive in this case, but rather in the master unit.

If required, one or a plurality of slave units can also be provided in the elevator system, which are designed exclusively to operate in this passive mode. However, at least one of the slave units present in the elevator system should be able to process signals and data actively, i.e. independently, and to generate control signals from the latter, by means of which an assigned safety function component can be controlled directly, without the participation of the master unit.

However, this slave unit is also subordinate to the master unit and thus, in accordance with one form of embodiment of the invention, can be designed to control the assigned safety function component independently only if it has been previously authorized to do so by the master unit. In other words, the master unit can control the slave unit appropriately, so that the latter either assumes an operating mode in which it independently controls its assigned safety function components, or it assumes an operating mode in which it does not operate independently, but rather, for example, forwards data in a passive manner.

The master unit can thus decide whether to execute certain control functions centrally, or whether these functions are to be performed in a decentralized manner by subordinate safety monitoring units in the form of slave units. If desired, the master unit can also instruct the slave unit as to how the latter is to execute a control function.

In accordance with a specific form of embodiment of the invention, at least one slave unit is designed to read in, via the input interface, data or signals that indicate a safety condition within the elevator system, and to monitor these independently and continuously by means of the data processing unit, and to transmit data or signals exclusively to the master unit via the data exchange channel, if a predeterminable critical safety condition is recognized on the basis of the data or signals. The slave unit can thus execute a considerable portion of the monitoring effort independently, and as a result can, for example, offload the master unit. It is only if the slave unit detects, for example, that on the basis of the signals or data read in and continuously monitored by the latter the conclusion is that the elevator system is not in a normal state, that the slave unit reports this to the master unit. For this purpose, the slave unit can forward the signals or data that it has read in directly to the master unit, or alternatively it can preprocess these and forward the preprocessed results to the master unit. Just the transmission of a kind of warning signal to the master unit is also conceivable. The master unit can then decide how to proceed further, and can, for example, instruct the slave unit to bring about measures, by suitably controlling safety function components, which transfer the elevator system back into the normal state, or at least into a safe state.

In accordance with one form of embodiment, each slave unit can exchange signals or data with the master unit via a data exchange channel. In other words, each of the slave units is connected to the master unit such that signals or data can be transmitted between the two units. Preferably, only a single data exchange channel exists between each slave unit and the master unit. The provision of a single common data exchange channel from the master unit to a plurality of slave units is also possible. A release of the data exchange channel for data transmission is preferably coordinated by the master unit.

Here the data exchange channel can be configured in any desired manner and in particular can be adapted for a specific type of data transmission or for a specific application.

For example, in accordance with one form of embodiment of the invention, the safety monitoring units and the data exchange channels can be designed for purposes of secure data transmission via the data exchange channels. For example, a security protocol can be used for purposes of data transmission. In this context data transmission can be considered to be "secure" if, for example, it corresponds to DIN ISO 61508, or fulfils the standardized Safety Integrity Level, SIL 3. Secured data transmission can contribute to the reliability of the safety monitoring system. In particular, any system errors or manipulations of the data transmission can be recognized.

Furthermore, in accordance with one form of embodiment of the invention, suitable bus systems can be provided within a data exchange channel for the specific assignment of data or signals to or from one of the slave units. Serial or parallel bus systems can be deployed. For example, a CAN-bus (controller area network) can be provided. Bus systems can provide controllable, fast, and/or reliable data transmission without each unit having to be directly wired to each other unit. Instead, the bus system can, for example, provide a shared data connection to various participants in a controllable manner.

In particular, bus systems can be provided for the transmission of data between master and slave units; these allow particularly fast data transmission so as to be able to ensure short transmission times and thus rapid response facilities within the safety monitoring system.

In accordance with one form of embodiment of the invention, the data exchange channels can be designed for purposes of wireless data or signal transmission. For example, data and/or signal transmission can take place with the aid of technologies such as WLAN (wireless local area network), RF data transmission (radio frequency), or optical data transmission, for example by means of modulated laser radiation. By this means the complexity of the wiring in the elevator system can be considerably reduced. Wireless data transmission, for example between an elevator car and an elevator shaft, could, for example, make possible an elevator system without travelling cables.

Alternatively, signals or data can also be transmitted along cables, for example by means of technologies such as Ethernet, UART (universal asynchronous receiver transmitter), or similar. Data transmission by the modulation of information on a power line, which actually serves, for example, to supply power within the elevator system, is also conceivable.

In accordance with one form of embodiment of the invention, the data processing unit of the master unit has a faster data processing rate than the data processing unit of the slave unit. In other words, the master unit and a slave unit differ with respect to their data processing capabilities. A slave unit, for example, is only designed to receive and process data or signals from specific sensors assigned to it, and then to control its assigned actuators. However, the master unit should be able to receive and process data and signals from various sources, and to forward control signals resulting therefrom to actuators. The quantity of data to be processed in the case of the master unit can therefore be significantly higher than in the case of a slave unit. In addition, the master unit should preferably be able to control and coordinate the rights and tasks of the slave units.

In accordance with one form of embodiment of the invention, the master unit is arranged on a central component such as, for example, a machine room, an elevator shaft, an elevator car, a counterweight, or an elevator pit, and at least one slave unit is arranged on another, peripheral component of the said group. The master unit can thus be arranged at a distance from one or each of the slave units. The distance between the master and slave unit can be several meters, for example more than 2 m or 10 m, up to several hundred meters, for example up to 200 m, 500 m or even 2000 m. The master or slave unit can be arranged directly on or near one of the components cited, in order to be able, for example, to monitor their functions. A distance between the master and slave unit can be considerably greater than a distance between the slave unit and its assigned safety function components, that is to say, sensors and actuators. In this way, data transmission times can be kept short, especially in operating situations in which safety function components are locally monitored and controlled by an independently operating slave unit.

The forms of embodiment of the invention provide a variety of advantages.

For example, the decentralized safety monitoring system herein proposed for an elevator system, which is subdivided into a plurality of various lower level safety components (sometimes also referred to as SSUs, safety supervision units), can enable the secure monitoring of distributed systems. This makes it particularly suitable for very tall elevators, so-called high-rise elevators. Here use can advantageously be made of the fact that the master unit and at least one slave unit are connected with one another via a communications channel and can mutually exchange information, wherein each of these master and slave unit combinations can have its own sensor system, which is monitored by the latter.

Through the deployment of various monitoring units, preferably spatially separated from one another, it is possible to monitor a larger system, that is to say, for example, a taller elevator shaft, and/or to group the monitoring tasks locally or logically.

From the decentralized, distributed arrangement of the system, smaller sections or sensor systems can ensue; these can be operated at a higher data transmission rate or a higher data processing rate.

Furthermore, by virtue of the subdivision into a plurality of subsystems with their own safety monitoring units, the number of participants, that is to say, for example, the number of safety function components monitored in total in the elevator system, can be increased. The safety of the elevator system can thereby be increased.

Various topologies or configurations can be envisaged.

For example, a plurality of interdependent safety monitoring units (SSUs) can be provided together with a master unit and one or more slave units. Here it is preferably only the master unit that can actively intervene, that is to say, for example, can exert influence on a safety circuit of the elevator system. All slave units communicate their status to the master unit, which can then, for example, decide whether there is currently a safety risk, and can initiate appropriate responses. In such an arrangement, the master unit is allowed to combine information from various units, and to react "more intelligently" accordingly. Compound advantages can be achieved overall.

Alternatively, a plurality of monitoring units can be provided that are independent of one another. Each or some of these units can have the opportunity to intervene and respond to a safety risk. In addition, for example, information can be exchanged between the units, e.g. for diagnostic purposes. In such an arrangement, however, as a general rule, there are no compound advantages, for example, as a result of the combination of superordinate information.

In general, a mixed form can also be implemented from the last-cited two topologies, that is to say, one with both interdependent units as well as independent units.

By means of a distributed system, various monitoring functions can be observed at distributed locations and can thus, for example, be laid over the entire elevator like a "security net". Alternatively, or additionally, results from various units can together form new results or monitoring functions, e.g. by virtue of the combination of information.

It is noted that some of the possible features and advantages of the invention are described herein with reference to various forms of embodiment. A person skilled in the art will recognize that the features may be suitably combined, adapted, or exchanged to achieve further forms of embodiment of the invention.

DESCRIPTION OF THE DRAWINGS

Forms of embodiment of the invention will now be described with reference to the accompanying FIGURES, wherein neither the FIGURES nor the description are to be construed as limiting the invention.

FIG. 1 shows a functional schematic of an elevator system in accordance with a form of embodiment of the invention.

This FIGURE is only schematic and is not drawn to scale.

DETAILED DESCRIPTION

FIG. 1 shows a schematic diagram of an elevator system 1 in accordance with an exemplary form of embodiment of the present invention. The elevator system 1 has a drive 3 and a car 5. The car 5 can be moved by the drive 3 along a path of travel within an elevator shaft 7. A cable 24, which is guided over pulleys 23, connects the car 5 with a counterweight 17.

The elevator system 1 has a multiplicity of detecting and/or activatable safety monitoring components 9*a*-9*p*, which are distributed over the entire elevator system and are arranged at various positions, for example within the elevator shaft 7, on its drive 3, or on doors of the elevator shaft 7 or the car 5.

A safety monitoring system 11 serves to monitor the elevator system in order, for example, to detect safety-critical conditions and, if required, to take suitable measures. Here the safety monitoring system 11 serves to monitor and coordinate the various safety function components 9*a*-9*p*.

The safety monitoring system 11 features a multiplicity of safety monitoring units 13*a* to 13*e*. The safety monitoring units 13*a* to 13*e* are arranged at various positions within the elevator system 1.

For example, a first safety monitoring unit 13*a* is arranged on the car 5 and is connected with a plurality of safety function components 9*c*, 9*d*, 9*e*, 9*l*, 9*k*, 9*j* that are also arranged there. The connection can be along cables, or can be wireless, and allows an exchange of data or signals. The safety function components can be detecting, and can, for example, be designed as sensors, detectors, contacts that can be actuated, or similar, so as to be able to determine operating conditions within the elevator system 1, that is to say, in this case on the car 5. The safety function components can also be activated and can, for example, be embodied as actuators, motors, or similar, in order to effect certain functions within the elevator system 1. For example, the safety function components 9*c*, 9*d*, 9*e*, 9*l*, 9*k*, 9*j* can be designed as a detecting component in the form of a capturing contact, an emergency end contact, an emergency brake switch, a car door contact, or similar, or as an activatable component, in the form of an actuator activating a braking device or a capturing device.

A second safety monitoring unit 13*b* can, for example, be arranged on the counterweight 17. A third safety monitoring unit 13*c* can, for example, be arranged in an elevator shaft pit 19. A fourth safety monitoring unit 13*d* can serve, for example, to monitor the doors of the elevator shaft 7. Each of these safety monitoring units 13*b*, 13*c*, 13*d* can be connected to one or more safety function components 9*f*, 9*g*, 9*h*, 9*i*, 9*m* that are provided locally and are assigned to the safety monitoring units, for example in the form of a slack cable contact, an emergency brake switch of the shaft pit, a slack cable contact of a speed limiter, or similar.

A fifth safety monitoring unit 13*e* is arranged on the drive 3, which is provided, for example, in a machine room. This safety monitoring unit 13*e* is connected to safety function components 9*a*, 9*b*, 9*n*, 9*o*, 9*p* located in the vicinity, for example in the form of a contact of a capturing device for the counterweight, a contact of a speed limiter, an emergency brake switch in the machine room, or similar.

Each or at least some of the safety monitoring units 13*a*-13*e* has its own data processing unit 20 (shown only for safety monitoring unit 13*e*). The data processing unit can comprise, for example, a processor, a CPU, or similar, possibly together with a storage medium for data storage. The safety monitoring units 13*a*-13*e* can furthermore have an input interface 21 and an output interface 22 (only shown for safety monitoring unit 13*e*), via which data can, for example, be read in by one of the detecting safety function components 9*a*-9*p*, or can be outputted to one of the activatable safety function components 9*a*-9*p*.

At least some of the safety monitoring units 13*a*-13*e* are thus able to carry out safety monitoring tasks at least locally independently, by reading in data or signals, for example, from sensors, processing them in the data processing unit, and then activating actuators appropriately.

All or at least some of the safety monitoring units 13*a*-13*e* are connected with one another by data exchange channels 15. Here the data exchange channels 15 can be embodied along cables, or wirelessly. Distances over which the safety monitoring units 13*a*-13*e* are connected with one another via the data exchange channels are here typically significantly greater than distances between one of the safety monitoring units 13*a*-13*e* and the safety function components 9*a*-9*p* assigned to it. The data exchange channels 15 can feature bus systems, with the aid of which a data transmission or data flow can be controlled.

In the example illustrated, the fifth safety monitoring unit 13*e* is embodied as a master unit, whereas the first to the fourth safety monitoring units 13*a*-13*d* are each embodied as slave units. Here the master unit is to be seen as superordinate to the slave units. All slave units are directly or indirectly connected with the master unit via data exchange channels 15. The master unit can thus receive data or signals from the slave units and can also transmit data or signals to the latter.

Here the master unit can, inter alia, also specify whether or in what manner data or signals are to be transmitted from one of the slave units to the master unit, or whether the slave unit is to operate independently.

For example, the master unit can specify to each of the slave units whether it is to transmit the data or signals that it receives from the detecting safety function components assigned to it only to the master unit, or whether it is to process these data or signals partially or completely independently. Mixed operating modes can also be used in which, for example, some data may be evaluated by the slave unit itself, but other data is to be forwarded unprocessed to the master unit. Partial preprocessing of the data received by the slave unit within the slave unit, and subsequent forwarding of the preprocessed data to the master unit, is also conceivable.

The master unit can also be connected to bus systems provided in the data exchange channels 15 and can be authorized to control, inter alia, a data flow through the data exchange channels 15.

The proposed elevator system 1, by virtue of its design, can be equipped with a decentralized design of safety monitoring system 11 with many safety monitoring units 13*a*-13*e* arranged in a distributed manner over the elevator system 1; these are organized in a master-slave hierarchy, enabling an extremely flexible mode of operation that can be adapted to various ambient conditions. In particular, monitoring tasks can be performed in a distributed manner over a plurality of safety monitoring units, wherein the master unit can, however, in principle, at all times retain control over the type and extent of the tasks performed by the slave units. This ensures a high level of security of the system. At the same time, however, the master unit does not necessarily have to have a very high data processing capacity, since it can leave a proportion of the safety monitoring tasks to the slave units. This can, inter alia, contribute to a cost reduction. Moreover, the monitoring tasks performed directly by the slave units can be carried out very rapidly, since data transmission distances can be kept short. This can, in turn, contribute to rapid reaction times and thus, for example, to an increased level of security of the elevator system, for example if a critical operating state is quickly recognized, and measures such as, for example, the activation of a braking device, or a catching device, are then to be initiated.

Finally, it should be pointed out that terms such as "having", "comprising", etc., do not exclude other elements or steps, and terms such as "one" do not exclude a large number. It should also be pointed out that features or steps that have been described with reference to one of the above examples of embodiment can also be used in combination with other features or steps of other examples of embodiment described above.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator system including a drive, a car that is operatively connected with the drive and is driven along a path of travel by the drive, a plurality of safety function components for providing safety functions at various positions within the elevator system, and a safety monitoring system for monitoring all the safety function components, the safety monitoring system comprising:

a plurality of safety monitoring units;

wherein each of the safety monitoring units has an input interface for reading in data or signals from at least one of the safety function components, and the safety monitoring units are connected with one another via at least one data exchange channel;

wherein the safety monitoring units are organized in a master-slave hierarchy, wherein one of the safety monitoring units is designed as a master unit, and each of the safety monitoring units other than the master unit is designed as a slave unit; and at least one of the designated slave units has a data processing unit for processing the data or the signals into control signals, and an output interface for outputting the control signals to at least one of the safety function components assigned to the at least one designated slave unit.

2. The elevator system according to claim 1 wherein all of the safety monitoring units designated as a slave unit have the data processing unit for processing the data or the signals into the control signals, together with the output interface for outputting the control signals to each of the safety function components assigned to a respective one of the designated slave units.

3. The elevator system according to claim 1 wherein the designated slave unit reads in, via the input interface, the data or the signals that indicate a safety condition within the elevator system, processes the data or the signals with the data processing unit, and independently controls the at least one assigned safety function component based on results of the processing.

4. The elevator system according to claim 3 wherein the designated slave unit controls each of the assigned safety function components independently, only if the designated slave unit was previously authorized to do so by the master unit.

5. The elevator system according to claim 1 wherein the designated slave unit reads in, via the input interface, the data or the signals that indicate a safety condition within the elevator system, monitors the safety condition independently and continuously with the data processing unit, and transmits the data or the signals exclusively to the master unit via the at least one data exchange channel, if a predetermined critical safety condition is recognized on a basis of the data or the signals.

6. The elevator system according to claim 1 wherein the designated slave unit reads in, via the input interface, the data or the signals that indicate a safety condition within the elevator system, and transmits the data or the signals via the at least one data exchange channel to the master unit, wherein the master unit processes the data or the signals with another data processing unit, and transmits processed results to the designated slave unit via the at least one data exchange channel, and wherein the designated slave unit controls the at least one assigned safety function component based on the transmitted processed results.

7. The elevator system according to claim 1 wherein each of the safety monitoring units designated as a slave unit exchanges the data or the signals with the master unit via an associated one of the at least one data exchange channel.

8. The elevator system according to claim 1 wherein the safety monitoring units provide secure data transmission via the at least one data exchange channel.

9. The elevator system according to claim 1 wherein the at least one data exchange channel transmits wirelessly the data or the signals.

10. The elevator system according to claim 1 wherein within the at least one data exchange channel has bus systems for specific allocation of the data or the signals to or from the designated slave unit.

11. The elevator system according to claim 1 wherein the master unit has a data processing unit with a faster data processing rate than a data processing rate of the data processing unit of the designated slave unit.

12. The elevator system according to claim 1 wherein the master unit is arranged on an elevator system component being one of the drive, a machine room of the elevator system, an elevator shaft of the elevator system, the car, a counterweight of the elevator system, and an elevator pit of the elevator shaft, and the designated slave unit is arranged on another of the elevator system components.

13. The elevator system according to claim 1 having at least two of the safety monitoring units being designed a slave unit.

14. An elevator system including a drive, a car that is operatively connected with the drive and is driven along a path of travel by the drive, a plurality of safety function components for providing safety functions at various positions within the elevator system, and a safety monitoring system for monitoring all the safety function components, the safety monitoring system comprising:

a plurality of safety monitoring units;

wherein each of the safety monitoring units has an input interface for reading in data or signals from at least one of the safety function components, and the safety monitoring units are connected with one another by data exchange channels;

wherein the safety monitoring units are organized in a master-slave hierarchy, wherein one of the safety monitoring units is designed as a master unit, and each the safety monitoring units other than the master unit is designed as a slave unit; and each of the designated slave units has a data processing unit for processing the data or the signals into control signals, and an output interface for outputting the control signals to at least one of the safety function components assigned to the designated slave unit.

* * * * *